United States Patent [19]

Bratton

[11] 4,013,185

[45] Mar. 22, 1977

[54] LIFT TRUCK ATTACHMENT

[75] Inventor: William Lee Bratton, St. Louis, Mo.

[73] Assignee: Whirlpool Corporation, Benton Harbor, Mich.

[22] Filed: Jan. 15, 1975

[21] Appl. No.: 541,224

[52] U.S. Cl. ..... 214/621; 214/750; 214/DIG. 5

[51] Int. Cl.[2] ..... B66F 9/12

[58] Field of Search ..... 214/620, 621, 750, 653, 214/10.5, 372, DIG. 10, DIG. 3, DIG. 4, DIG. 5; 294/67 AA, 67 AB; 211/150, 170; 312/325, 327, 328

[56] References Cited

UNITED STATES PATENTS

| | | | |
|---|---|---|---|
| 1,562,089 | 11/1925 | Holley | 211/150 |
| 2,699,269 | 1/1955 | Ulinski | 214/621 |
| 3,023,919 | 3/1962 | Hobson | 214/620 |
| 3,485,382 | 12/1969 | Larson | 211/150 |
| 3,567,054 | 3/1971 | Emke | 214/750 |
| 3,643,825 | 2/1972 | Zane, Jr. | 214/620 |
| 3,866,780 | 2/1975 | Miller et al. | 214/DIG. 4 |

*Primary Examiner*—Frank E. Werner
*Assistant Examiner*—Ross Weaver
*Attorney, Agent, or Firm*—Wenger, Stellman, McCord, Wiles & Wood

[57] ABSTRACT

A lift truck attachment for use with squeeze-type lift trucks permitting handling of loads having lateral dimensions substantially greater than the spacing of the squeeze members and arranged to permit handling of relatively deformable loads normally not suitable for handling by squeeze-type truck apparatus. The attachment includes a frame structure adapted to be squeezed by the squeeze members and provided with a selectively forwardly projecting fork for lifting loads through the intermediary of the squeeze members. The frame further includes a hook shaped blade for carrying loads adapted to be lifted by blade structures permitting the attachment to be selectively utilized in alternative manners in handling different types of loads.

16 Claims, 6 Drawing Figures

LIFT TRUCK ATTACHMENT

BACKGROUND OF THE INVENTION

1. Field of the Invention

This invention relates to material handling apparatus and in particular to apparatus for use with squeeze trucks in handling different types of loads normally not suitable for handling by conventional squeeze truck structures.

2. Description of the Prior Art

In one conventional fork lift truck apparatus, such as shown in U.S. Pat. No. 3,180,512 of Fred D. Moss, a fork lift truck is provided with a forwardly extending fork which is selectively elevated for lifting a load to permit the transport thereof by suitable movement of the truck, as desired. In said Moss patent, an attachment is provided to be mounted on the fork for automatically gripping a drum when the attachment is moved by the truck against the drum and subsequent vertical or tilting movement of the fork lift mast is effected.

In another form of fork lift truck, as shown in U.S. Pat. No. 2,671,571 of Otto J. Gerhardt, arms are provided for squeezing a load horizontally therebetween so as to permit lifting of the load without the need for introduction of the fork under the load as in conventional fork lift operation. In the Gerhardt patent, the squeezing members are rotatable so as to selectively define conventional horizontally extending fork means. Further, alternatively, in the Gerhardt structure, the squeeze members may be disposed in a diagonal plane, such as for use in supporting barrels or the like.

SUMMARY OF THE INVENTION

The present invention comprehends an improved material handling structure comprising an attachment for use with a transportive squeeze truck having horizontally spaced squeeze members which may be selectively urged toward each other to engage and carry a load therebetween. The squeeze members are suitably carried on the truck for lifting the load for transport, as desired.

The attachment of the present invention comprises a frame structure having movably mounted thereon fork means which, when the frame is grasped by the squeeze members, may define a forward fork structure for lifting loads in the manner of conventional lift truck fork means.

In the illustrated embodiment, the fork means may be movably mounted to the frame so as to be disposed in a retracted position when desired, for facilitating storage and manipulation of the attachment when separated from the lift truck.

The frame may further include a hook shaped blade for lifting loads having portions adapted to be lifted by such blade means. One conventional form of packaging of relatively large structures such as furnaces, is a tube-and-cap arrangement wherein a parallelepiped tube is closed at its opposite ends by closure caps secured to the tube ends by straps. Such packages may be transported by insertion of hook shaped blade means to between the downturned cap flange and the tube end under the strap permitting the package to then be lifted without causing the cap to become separated from the tube. The attachment of the present invention includes suitable blade means for effecting such tube-and-cap load handling.

The attachment of the present invention further comprehends the provision of stop means for positive support of the frame when gripped between the squeeze members. In the illustrated embodiment, the stop means comprises means defining downwardly opening channels at the top sides of the frame adapted to receive the upper edges of the squeeze members of the truck and thereby positively supporting the frame on the squeeze members in addition to the normal squeezing grip of the members on the frame carried therebetween.

The present invention further comprehends means for retaining the movable fork structure in the retracted position which may be manually operable to permit the fork to be readily disposed in the forwardly extending lift position, when desired. The retaining means may comprise latch means and means for biasing the latch means into engagement with the fork means for retaining the fork in the retracted position, when desired. The latch means may further be arranged to prevent movement of the fork from the lift position to the retracted position, when desired.

In the illustrated embodiment, the fork is pivotally carried by the frame at a position spaced above the bottom of the frame and means are provided on the frame for limiting the downward pivoting of the fork downwardly to the preselected lift position.

The lift truck attachment of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
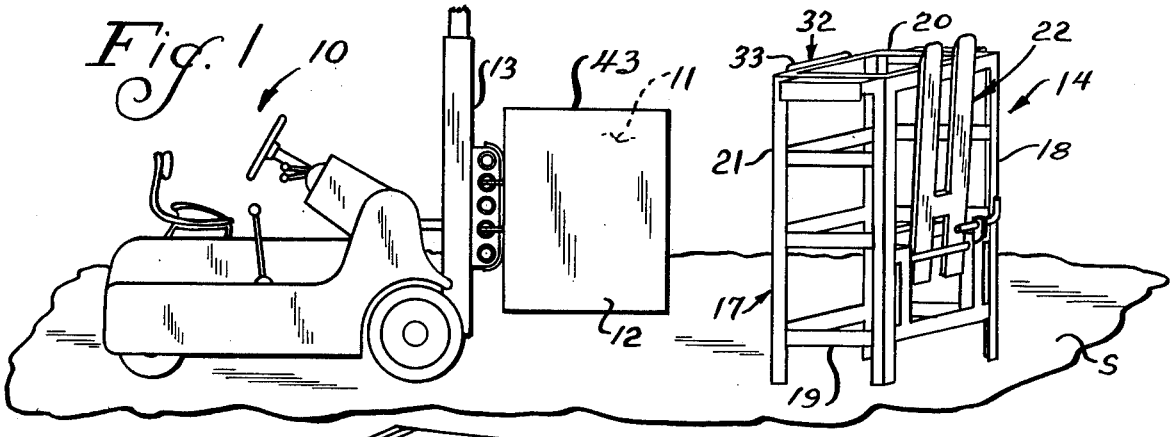
FIG. 1 is a perspective view of a lift truck of the squeeze type in position to grip an attachment embodying the invention between the gripping members thereof.

In the exemplary embodiment of the invention as disclosed in the drawing, a lift truck generally designated 10 is shown to comprise a transportive wheeled vehicle having a pair of squeeze members 11 and 12 carried on a suitable vertically movable support 13 for movement toward and from each other to grip a load in a squeezing manner therebetween for suitably lifting and transporting the load as desired. Such squeeze truck apparatuses are well known in the art and require no further description herein.

The present invention is concerned with an improved attachment generally designated 14 adapted to be gripped by the squeeze members 11 and 12 for handling loads not normally adapted for handling and transport by such squeeze load handling apparatus. Thus, the attachment 14 is adapted for lifting and transporting a load 15 having a horizontal dimension substantially greater than the maximum spacing between the squeeze members 11 and 12. Further, the attachment 14 is adapted for handling a load, such as load 16, which is relatively compressible and not normally capable of being handled by such squeeze truck means without undesirable damage to the load. The load arrangement shown in FIG. 2 may occur as in trailer truck shipments where relatively large volume packages, such as furnaces enclosed in suitable cartons are placed in the trailer truck with two such cartons extending vertically in side-by-side relationship and a third such carton placed horizontally on top of subjacent vertical packages. Heretofore, unloading such cartons has required the use of two men to lift the top carton down from the subjacent cartons, and to set it upright for subsequent removal from the trailer truck in the same manner as the removal of the packages 16. Where the packages 15 and 16 are relatively undeformable packages, such as packaged refrigerators, the squeeze truck 10 may be utilized to remove the upright packages in a normal squeeze grip transport manner.

Attachment 14 comprises a box frame 17 defining a front portion 18, a bottom portion 19, a top portion 20, and a rear portion 21. Frame 17 may comprise an open box frame formed by interconnecting upright and horizontal members which may conventionally be formed of a rigid material, such as angle iron, to accomodate the squeezing action of the squeeze members 11 and 12 without deformation thereof.

Attachment 14 is provided with a fork 22 which is movably mounted to frame 17 and in the illustrated embodiment, is pivotally mounted thereto by suitable pivots 23 for swinging about a horizontal axis at the top of bottom portion 19 of the frame. The pivots may be carried on suitable support portions 24. Downward pivoting of the fork (in a counterclockwise direction as seen in FIG. 4) is limited to a horizontal load position by a lower front transverse stop member 25 extending across the frame between support portions 24 and an upper rear transverse stop member 26.

Figure 3:
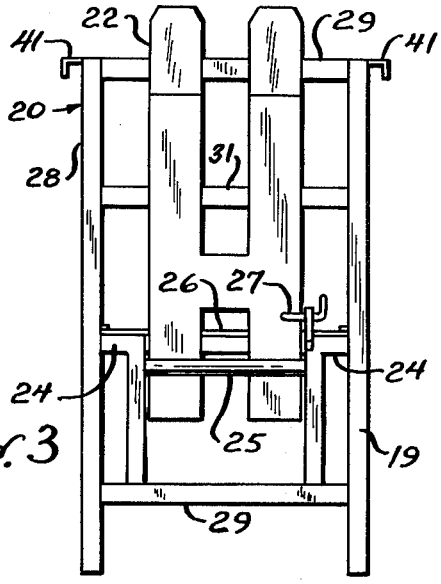
FIG. 3 is a front elevation of the attachment.
Figure 4:
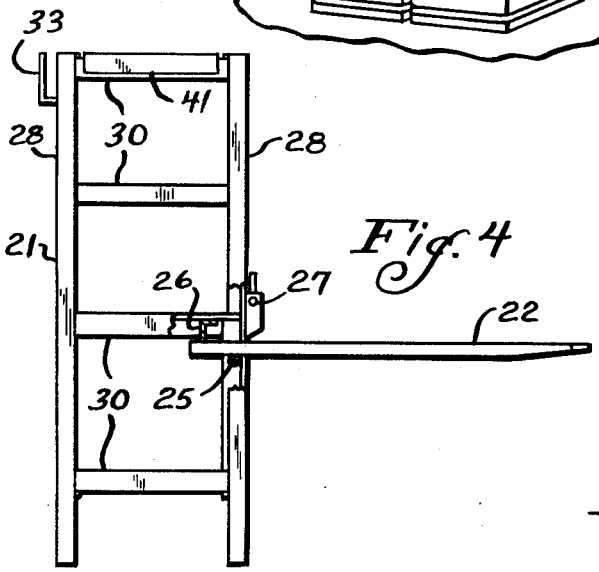
FIG. 4 is a right side elevation thereof.
Figure 5:
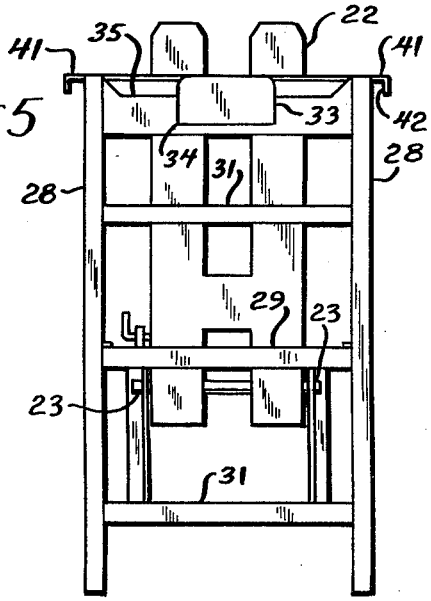
FIG. 5 is a rear elevation thereof.
Figure 6:
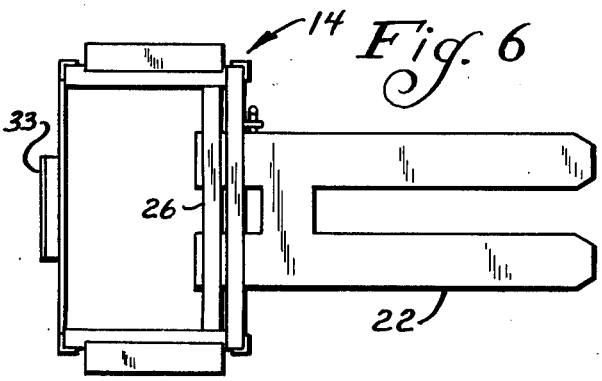
FIG. 6 is a top plan view thereof.

A manually operable latch 27 is carried by one support 24 to project into the path of swinging of the fork 22 when the fork is pivoted to the substantially upright retracted position of FIGS. 1, 3 and 5, thereby selectively retaining the fork in the retracted position as during storage and manipulation thereof separate from the lift truck. The latch may be spring biased into the path of movement of the fork, as shown in FIG. 3, and upon swinging of the fork to the horizontal load position of FIG. 4, further serves to prevent upward movement of the fork (in a clockwise direction as seen in FIG. 4) until manipulated to the release position.

As shown, the frame includes upright corner posts 28, transverse front cross members 29, horizontal side members 30 and transverse rear cross members 31 defining an open box frame. The posts and members may comprise angle iron elements suitably secured such as by welding to define a generally parallelepiped frame.

When it is desired to lift a load by means of the fork 22, the lift truck operator merely grips the frame between the squeeze members 11 and 12 whereupon release of the latch 27 may be effected to permit the fork to swing downwardly to the load position of FIG. 4. The lift truck may then be driven suitably to insert the fork 22 under the load, such as load 15, as shown in FIG. 5, permitting subsequent raising of the load on the fork and transport thereof by suitable wheeled movement of the lift truck, as desired. The load is delivered from the attachment 14 by the operator lowering the load to set frame 17 on the subjacent surface S. The load 15 may then be tipped to an upright position removing it from the fork and permitting the fork to be returned to the retracted position and latched therein by the operator suitable manipulating the fork and latch.

The lift truck may then be utilized in the normal squeeze truck manner by withdrawing the truck from the attachment. Thus, load 15 may be subsequently handled in the normal squeeze-type handling manner wherein it is engaged between the squeeze members 11 and 12 in a conventional squeeze-type grip action.

Figure 2:
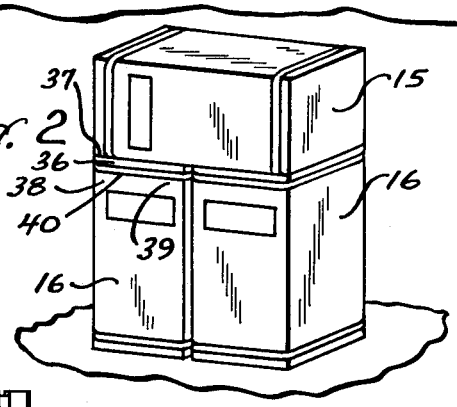
FIG. 2 is a perspective view of a stacked load which the attachment is adapted to handle.

As indicated above, at times, the load 16 may comprise a relatively deformable package precluding the use of the conventional squeeze means 11 and 12. To permit the handling of such loads, the attachment 14 is provided with a hook shaped blade generally designated 32 comprising a flat, upright blade 33 secured at its lower edge portion 34 to a cross member 35 extending across the top rear portion 21 of the frame. Hook blade 33 is adapted to fit under the downturned flange 36 of a cap-type cover 37 closing the upper end of the tubular carton 38 enclosing a relatively deformable load, such as a furnace. As shown in FIG. 2, the downturned flange may be compressed against the upper end portion 39 of the tube carton 38 by an encircling strap 40 effectively positively securing the cap to the tube end.

To lift and transport such loads, the lift truck operator picks up attachment 22 with the rear portion 21 outermost. The lift truck carrying the attachment is then brought to the load and hook blade 33 urged upwardly under the downturned flange 36 of the cap 37 so as to lift the load 16 and permit suitable transport thereof while so carried. The load is delivered at the desired delivery point by lowering of the load until the frame rests on the subjacent surface S with the hook blade 33 being urged downwardly from under the cap flange 36 to separate the attachment from the load.

As shown in FIG. 5, the blade 33 pivotally has a substantial lateral extent so as to distribute the lifting force over a substantial length of the cap 37 for improved handling of the load.

To provide effectively positive support of the attachment by the squeeze members 11 and 12 while minimizing the amount of squeezing force necessary to carry the load by means of the attachment, frame 14 may further be provided with channel members 41 at the opposite sides of the top portion 20 defining downwardly opening channels 42 adapted to receive the upper edges 43 of the squeeze members 11 and 12 and thereby positively support the attachment 14 on the squeeze members during the load handling operation. The engagement of the attachment by the squeeze members is effected by bringing the squeeze members approximately to the sides of the frame and raising the thusly positioned squeeze members to bring the upper portion 43 into the channels 42. The final squeezing of the frame may then be effected to secure the attachment in positive association with the lift truck squeeze members.

Attachment 14 is extremely simple and economical of construction while having long maintenance-free life and affording improved facilitated handling of different loads by a single squeeze-type lift truck with effectively minimum manpower. The load handling operation is speeded up to provide cost savings in this respect, and the handling of different loads is made relatively safe by the facilitated use of the attachment and lift truck in the different manners discussed above.

The foregoing disclosure of specific embodiments is illustrative of the broad inventive concepts comprehended by the invention.

Having described the invention, the embodiments of the invention in which an exclusive property or privilege is claimed are defined as follows:

1. An attachment for selectively converting a transportive squeeze truck to a fork lift truck, the squeeze truck having a pair of horizontally spaced squeeze members, means for selectively urging the squeeze members together to hold an object to be carried therebetween and means for lifting the squeeze members to lift the load carried therebetween, said attachment comprising: a box frame having a bottom portion adapted to stand on a support surface, said frame being constructed to prevent destructive squeezing deformation thereof by the squeeze members of a squeeze truck to permit the frame and a load thereon to be carried for transport by the truck; fork means movably carried by the frame substantially above said bottom portion to extend in a lift position horizontally therefrom a preselected distance above the support surface for disposition under a load to be lifted and transported by the truck for placement of the bottom portion on the support surface with the load supported at said preselected distance above the support surface; means for selectively retaining the fork means in a retracted position; support means on said frame arranged to overlie a portion of the truck squeeze members when the squeeze members are caused to engage the sides of the frame for squeezingly gripping the frame, whereby said support means provide a positive stop limiting movement of said frame downwardly between the squeezing members during a load carrying operation; and means on a rear portion of said frame defining an upwardly turned hook for hooking under a load to be lifted and transported by the truck.

2. The squeeze truck attachment of claim 1 wherein means are provided for pivotally securing the fork means to said frame for pivoting of the fork means about a horizontal axis.

3. The squeeze truck attachment of claim 1 wherein means are provided for pivotally securing the fork means to said frame for pivoting of the fork means about a horizontal axis at the top of said bottom portion.

4. The squeeze truck attachment of claim 1 wherein means are provided for pivotally securing the fork means to said frame for pivoting of the fork means about a horizontal axis at the top of said bottom portion and stop means are further provided on the frame for limiting the downward pivoting of the fork means to the horizontal disposition.

5. The squeeze truck attachment of claim 1 wherein means are provided for pivotally securing the fork means to said frame for pivoting of the fork means about a horizontal axis at the top of said bottom portion, said fork means including a portion extending rearwardly of said pivot axis, and stop means are provided on the frame for selective engagement by said fork means portion to limit the downward pivoting of the fork means to the horizontal disposition.

6. The squeeze truck attachment of claim 1 wherein means are provided for pivotally securing the fork means to said frame for pivoting of the fork means about a horizontal axis, and manually operable means are provided for selectively preventing upward movement of the fork from the horizontal position.

7. The squeeze truck attachment of claim 1 wherein said retaining means is arranged to retain the fork means in a substantially vertically extended retracted disposition.

8. The squeeze truck attachment of claim 1 wherein said frame defines a front and said retaining means is arranged to retain the fork means in a substantially vertically extended retracted disposition substantially coincident with said front of said frame.

9. The squeeze truck attachment of claim 1 wherein said frame defines a front and said retaining means comprises a manually operable latch means arranged to retain the fork means in a substantially vertically extended disposition substantially coincident with said front of said frame.

10. The squeeze truck attachment of claim 1 wherein said frame defines a front and said retaining means comprises a manually operable latch means arranged to retain the fork means in a substantially vertically extended retracted disposition substantially coincident with said front of said frame, and means for biasing the latch means to the fork retaining position.

11. The squeeze truck attachment of claim 1 wherein said support means comprises downturned brackets on the frame defining downwardly opening channels adapted to receive an upper edge portion of the squeeze members.

12. The squeeze truck attachment of claim 1 wherein said support means are carried on a top portion of the frame.

13. The squeeze truck attachment of claim 1 wherein said support means comprise L-shaped members extending between the front and rear of the frame at the top thereof and defining downwardly opening channels adapted to receive an upper edge portion of the squeeze members.

14. The squeeze truck attachment of claim 1 further including means for pivotally securing the fork means to said frame for pivoting of the fork means about a horizontal axis, and manually operable means are provided for selectively preventing upward movement of the fork from the horizontal position.

15. The squeeze truck means attachment of claim 1 wherein said frame defines a front portion carrying said fork means and a rear portion carrying said hook.

16. The squeeze truck means attachment of claim 1 wherein said hook comprises a flat blade projecting upwardly from said rear portion of the frame.

* * * * *